US005230110A

United States Patent [19]

Rose

[11] Patent Number: 5,230,110

[45] Date of Patent: * Jul. 27, 1993

[54] MATTRESS CUSHION WITH MULTIPLE ZONES

[75] Inventor: Robert J. Rose, Chesterfield, Va.

[73] Assignee: E. R. Carpenter Company, Inc., Richmond, Va.

[ * ] Notice: The portion of the term of this patent subsequent to Aug. 4, 2009 has been disclaimed.

[21] Appl. No.: 915,287

[22] Filed: Jul. 20, 1992

Related U.S. Application Data

[63] Continuation of Ser. No. 609,712, Nov. 5, 1990, Pat. No. 5,134,735.

[51] Int. Cl.[5] ..... A47C 24/14

[52] U.S. Cl. ..... 5/464; 5/481; 5/901

[58] Field of Search ..... 5/481, 464, 468, 448, 5/420, 900.5, 901; 297/DIG. 1; D6/596, 605

[56] References Cited

U.S. PATENT DOCUMENTS

| | | | |
|---|---|---|---|
| D. 174,812 | 5/1955 | Huller . | |
| D. 311,108 | 10/1990 | Farley | D6/596 |
| 3,197,357 | 7/1965 | Schulpen | 5/481 |
| 3,604,025 | 9/1971 | Mims | 5/481 |
| 3,681,797 | 8/1972 | Messner . | |
| 3,828,378 | 8/1974 | Flam | 5/481 |
| 3,846,857 | 11/1974 | Weinstock | 5/464 |
| 4,042,987 | 8/1977 | Rogers . | |
| 4,110,881 | 9/1978 | Thompson . | |
| 4,399,574 | 8/1983 | Shuman . | |
| 4,620,337 | 11/1986 | Williams et al. | 5/464 |
| 4,679,266 | 7/1987 | Kraft | 5/464 |
| 4,700,447 | 10/1987 | Spann | 5/481 |
| 4,741,058 | 5/1988 | Williams et al. | 5/481 |
| 4,768,251 | 9/1988 | Baskent | 5/464 |
| 4,879,776 | 11/1989 | Farley | 5/481 |
| 4,901,387 | 3/1990 | Luke | 5/481 |
| 4,999,868 | 3/1991 | Kraft | 5/464 |
| 5,038,433 | 8/1991 | Farley | 5/481 |

FOREIGN PATENT DOCUMENTS

| | | | |
|---|---|---|---|
| 1399343 | 4/1965 | France | 5/464 |

*Primary Examiner*—Alexander Grosz
*Attorney, Agent, or Firm*—Beveridge, DeGrandi, Weilacher & Young

[57] ABSTRACT

A mattress overlay cushion including three distinct zone sections with the intermediate zone section extending a greater distance longitudinally than the other two zone sections. Each zone section has a convoluted surface with a protuberance arrangement distinct from that of the others. A first and a second zone section feature a plurality of rounded peaks. Rounded peaks in the first zone are arranged in a plurality of transversely extending rows of individual peak members separated by valleys with the rounded peaks in each transversely extending row being offset transversely with respect to a longitudinally adjacent row. A plurality of peak members in the second zone are arranged in sets with each of the peak members within a particular set are joined at a base portion in a region above a maximum depth of the valleys such that adjoined peak members extend diagonally within each set. Thus, valleys are transversely positioned between adjacent sets of diagonally extending adjoined peak members.

15 Claims, 5 Drawing Sheets

MATTRESS CUSHION WITH MULTIPLE ZONES

This is a continuation of co-pending application Ser. No. 07/609,712 filed on Nov. 5, 1990 now U.S. Pat. No. 5,134,735.

BACKGROUND OF THE INVENTION

The present invention relates to a mattress cushion having multiple zones of comfort along its length. More specifically, the present invention features a foam mattress overlay having a convoluted upper surface with three distinct zones each particularly suited for supporting a particular portion of a human body so as to avoid the formation of decubitus ulcers, poor body alignment and discomfort.

BACKGROUND DISCUSSION

Various mattress cushions have been presented in the prior art which are directed towards reducing the pressure that the mattress cushion exerts against the skin of a person lying on the mattress. These attempts to minimize the pressure exerted against the person is for the purpose of avoiding the formation of decubitus ulcers or, more commonly, bed sores. In general, the foam mattress cushions presented in the prior art have followed three different approaches in an attempt to reduce the pressure level against the skin of a person while maintaining sufficient support and comfort. The first of the three involves the use of different foam grades (e.g., different densities) over the length of the mattress. An example of this first approach is found in U.S. Pat. No. 4,768,251 which illustrates a mattress pad having a torso section formed of a different ILD and density value than the remaining head and feet sections of the mattress pad.

The second of the three approaches generally relied upon in the prior art involves the use of a plurality of stacked layers of different foam characteristics. An example of this approach can be found in U.S. Pat. No. 3,846,857 which features a polyurethane foam mattress having a central section formed of a pair of stacked foam slabs with the upper slab having a different density and degree of compressibility than the lower slab. A further illustrations of the layer approach is found in U.S. Pat. No. 4,276,666 which discusses the forming of a cushion with two layers of sponge wherein the upper layer is formed of a soft material and the lower layer of a harder material.

The last of the three approaches generally relied upon in the prior art involves variations in the upper surface configuration of the mattress pad which can include variations in the cross-sectional height of the mattress pad or the use of different patterns of convolutions. An example of the utilization of both the method of varying the height of a mattress pad along its length and the use of two different patterns of convolutions, can be seen in U.S. Pat. Nos. 4,620,337 and 4,741,058. Each of these patents disclose a mattress pad having a head and a foot supporting section both of which are formed of a convoluted, checkerboard pattern of rows of peaks separated by depressions each of which slope upwardly in an inward to outward direction.

The prior art mattress cushions, especially those produced in accordance with the three above noted prior art techniques, fail to fully appreciate the differences in comfort and pressure application between the three body zones which include the middle or torso section, the head and shoulder section, and the lower leg and feet section. In addition, the prior art not only fails to fully appreciate the different requirements of these three body zones but also introduces mattress pads which, in attempting to achieve variations in support, present added difficulty in manufacturing due to the requirement for different materials and different layers.

SUMMARY OF THE INVENTION

The present invention features a mattress cushion having three distinct areas of support, with each area of support specifically designed to combine equitable body weight distribution and sufficient support to prevent individual body distortion with respect to the section of the body being supported. The present invention is designed for maximum comfort and pressure relief for each of the three body sections. A first zone section of the mattress cushion takes into account the fact that the head and shoulder area of a person has a weight which is generally greater in overall weight than the lower leg and feet section but lesser in overall weight with respect to the torso section. The first zone section features a plurality of wedge shaped peaks combinations separated by laterally extending rows of individual peaks. The wedge shaped peak combinations and lateral rows of individual peaks are dimensioned and configured to provide support which is proportional to the weight differentiation between the head and shoulder area and the torso area.

The mattress cushion of the present invention is preferably formed of a single layer and of a single material. The torso section of the mattress cushion of the present invention features a convoluted surface having dual level peaks separated by depressions. More specifically, the torso section of the mattress cushion includes a first and a second set of peaks with the height of the first set of peaks being greater than the height of the second set of peaks. The second set of peaks includes laterally extending rows of serially arranged individual peaks. The lateral rows of individual peaks separate groupings of peaks provided in the first set of peaks.

In a preferred embodiment, the individual peaks within the first set are positioned between adjacent lateral rows of the peaks in the second set. The individual peaks in the first set of peaks are arranged so as to have a first laterally extending row offset from a second laterally extending row with both laterally offset rows positioned between the laterally extending rows of peaks from the second set.

The above described arrangement of the convoluted surface for the second zone section provides a soft and gentle initial contact between the torso section of the body and the higher level peaks. As a person's full body weight presses down upon the mattress cushion, contact is made with the lower level peaks to provide a more even distribution of support, especially in the heavier hip or bottom area of the person's body. This arrangement of the second section is important as the middle section of the body or torso area is often where more than 50 percent of a person's weight rests when sleeping. The remaining 50 or so percent is thus split between the head and shoulder area and the lower leg and feet area with the head and shoulder area comprising about 25 to 30% and the lower leg and feet section about 20 to 25%.

As noted above, the configuration and arrangement of the convolutions in the first zone section are designed to provide proportional support with respect to the support required for the heavier torso area.

The design of the third zone section includes a plurality of adjacent, continuous zig zag ridges comprising a plurality of peaks integrally formed with one another. The zig zag ridges are designed to give moderate support to the lightest of the three body sections while still providing sufficient area for the skin to breath.

The three distinct designs not only achieve equitable body weight distribution (i.e., a body weight distribution which maximizes possible surface area use), but does so while still providing sufficient support to prevent unnatural body distortions. Moreover, the varying support for the head, torso and leg regions of the body helps to place the back of the user level.

ILD values represent the amount of displacement force required to displace a pad a predetermined percentage (e.g., 5%, 25%, and 65%) of the pad's total thickness. Thus, a foam pad having an ILD value of 14 for a deflection of 25% would require a load of 14 pounds to deflect a four inch thick pad one inch. For convoluted surfaces the ILD values at 25% and 65% become of chief importance as the 25% ILD value is a good indication of the initial softness of the mattress cushion while the 65% ILD value provides a good indication as to the "support factor" of the mattress cushion. Typically the "support factor" of a mattress cushion is placed in terms of the compression modulus for the mattress cushion which represents the ratio of ILD values at 65% and 25% deflections. A comfortable mattress cushion should have a relatively low 25% ILD value (e.g., no more than 20 pounds) and a sufficiently high compression modulus (e.g., 2.5–3.5). Most solid polyurethane foams have a compression modulus value below 2.0 and thus the convoluted surface helps to provide a means for lowering the compression modulus at the outset. In a preferred embodiment of the present invention, each of the three sections has a different compression modulus value with all three lying within the range of about 2.5 to 3.5. The second zone section for the torso is provided with the highest of compression modulus values while the first zone section is provided with the second highest and the third zone section is provided with the lowest compression modulus value. The density of the material forming the mattress cushion preferably is from about 1.2 to 1.6 $lb/ft^3$.

The aforementioned characteristics of the present invention result in a mattress cushion which achieves low mattress cushion pressure exertion readings while, at the same time, providing a comfortable and well supportive mattress cushion. Thus, the chance of decubitus ulcers forming is reduced especially for bed ridden patients who require low pressure exertion and fully appreciate a comfortable and supportive cushion.

BRIEF DESCRIPTION OF THE DRAWINGS

The aforementioned advantageous features of the present invention will become apparent from the specification, drawings and claims. In the accompanying drawings, in which like numerals indicate like parts:

DETAILED DESCRIPTION OF THE PREFERRED EMBODIMENTS

Figure 1:
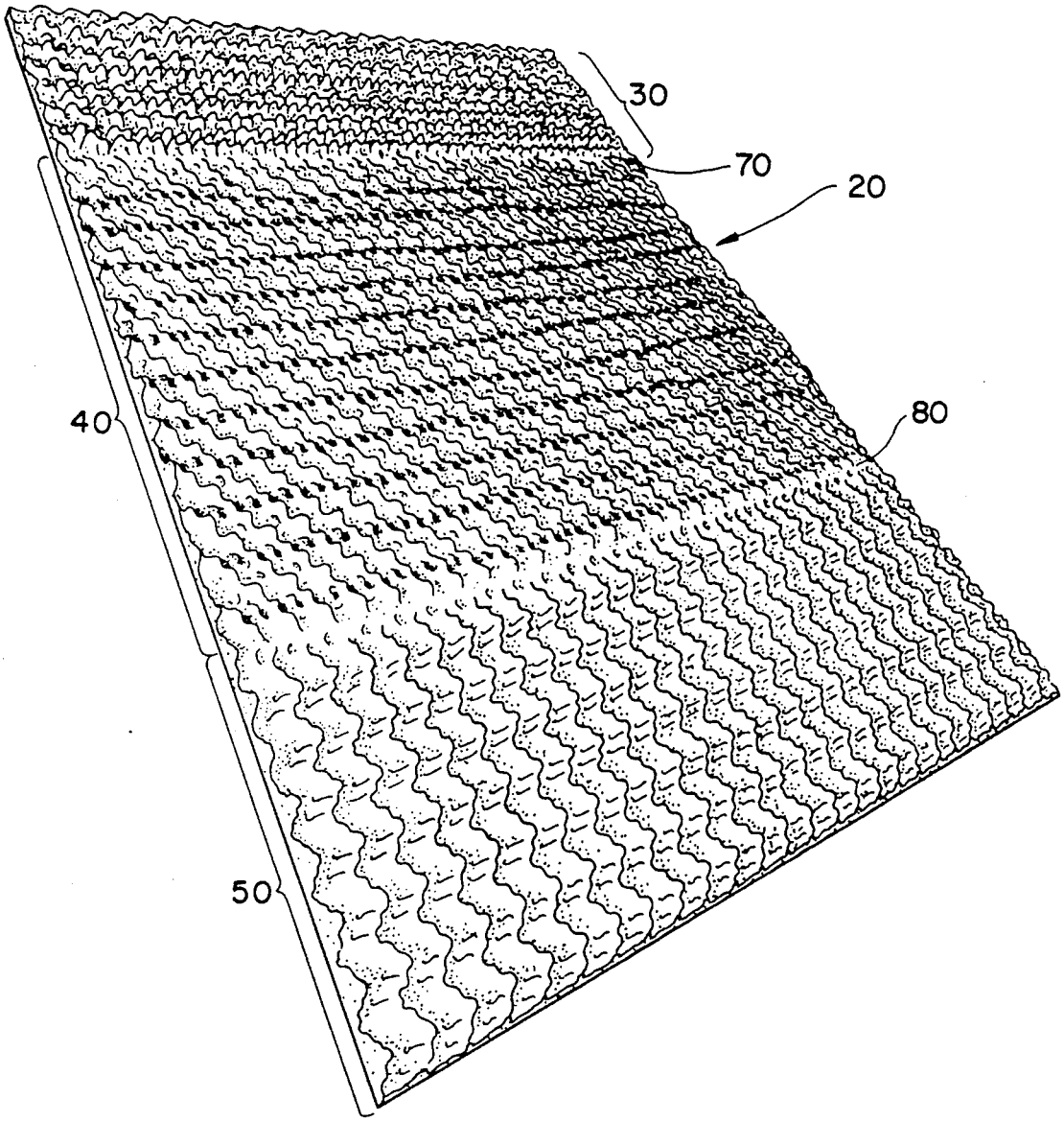
FIG. 1 is a perspective view of one embodiment of the present invention.

FIG. 1 illustrates a perspective view of mattress cushion 20 having first zone section 30, second zone section 40, and third zone section 50. Zone sections 30, 40 and 50 each have a different convoluted upper surface which provides comfortable support as well as low pressure contact points to avoid the formation of decubitus ulcers. Mattress cushion 20 is generally designed for placement over an underlying mattress (not shown) such as an innerspring mattress. First zone section 30 is designed for supporting the head and shoulder region of a person lying on mattress cushion 20. The second zone section 40 is designed for support of the torso area of a person lying on mattress cushion 20. The third zone section 50 is designed for supporting the feet as well as at least the lower portion of a person's legs. First zone section preferably is integral along transition area 70 with one end of second zone section while the other end of the second zone section is integral along transition area 80 with one end of the third zone section.

Figure 2:
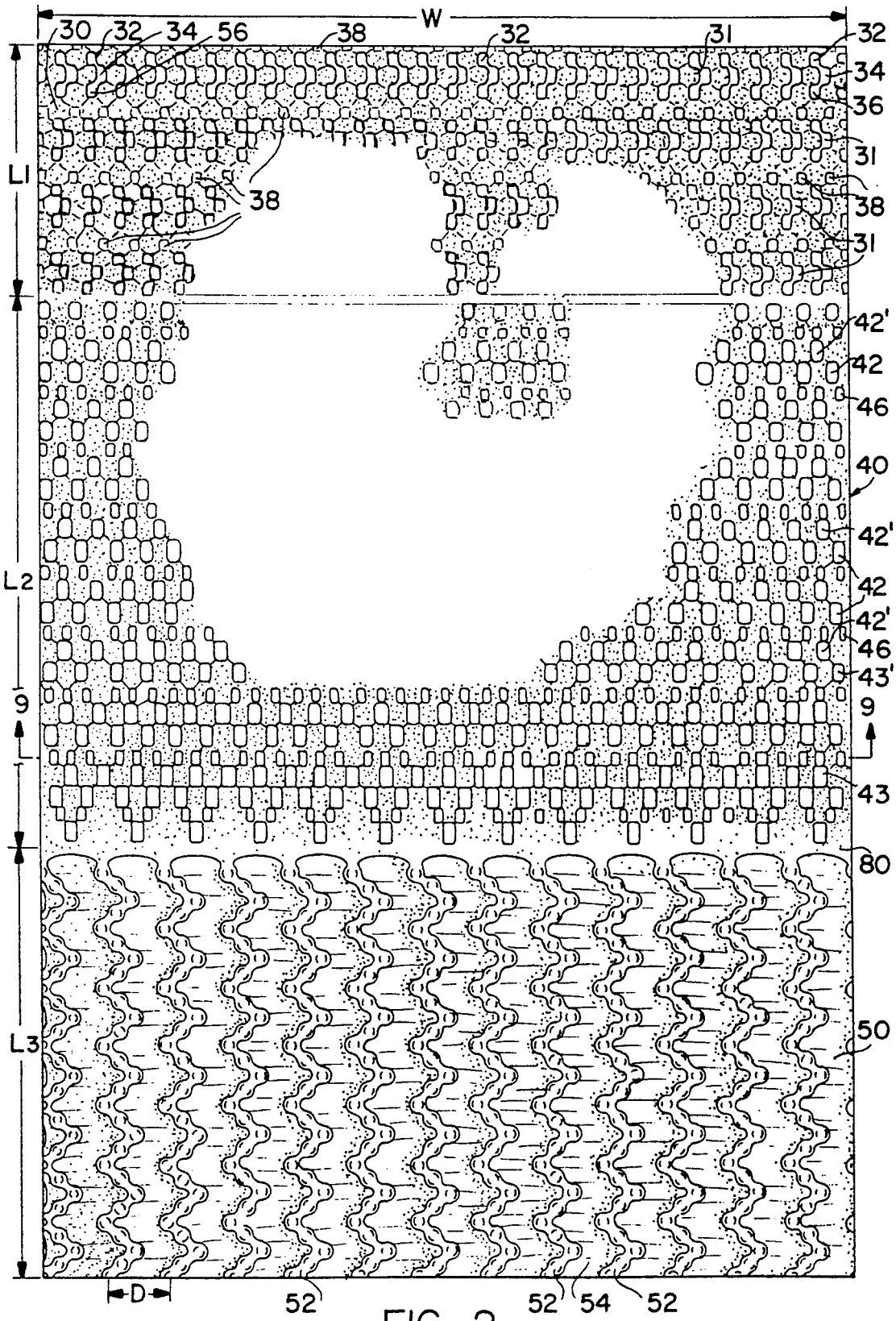
FIG. 2 is a planar view of a mattress shown in FIG. 1.

FIG. 2 shows mattress cushion 20 in planar view with a portion removed for draftsman's convenience. As shown in FIG. 2, first zone section 30 has a longitudinal length L1 which is preferably about 22 to 26 inches and even more preferably about 24 inches. FIG. 2 further illustrates second zone section 40 being of a length L2 which is preferably about 34 to 38 and even more preferably about 36 inches. Third zone section 50 has a longitudinal length L3 which is preferably about 18 to 22 in length and even more preferably about 18 inches in length.

The width of each section W is shown in FIG. 2 to be equal for all sections and width W can be within a range of about 38 to 46 and in one embodiment is about 42 inches. The total length of mattress cushion 20 (i.e., L1+L2+L3) is preferably of a length which fits over the most common size box springs or mattresses used in health care facilities. Likewise, width W is dimensioned so as to cover, but not overlap, the mattress over which mattress cushion 20 is placed.

First zone section 30 is shown in FIG. 2 to comprise a plurality of wedge shaped peak combinations 31 arranged in a plurality of laterally extending rows. Each wedge shaped peak combination is formed of three peaks 32, 34 and 36 integrally joined along adjacent edges so as to form a continuous extension with peak 34 forming the vertex of the wedge shaped combination. Extending between adjacent rows of wedge shaped peak combinations 31 are a plurality of individual peaks 38 serially arranged in lateral rows.

Second zone section 40 is shown in FIG. 2 to have a convoluted upper layer with a first set of wider base peaks 42, 42' which are arranged in groups comprising a pair of offset lateral rows, such as the pair of rows designated in FIG. 2 as 43 and 43'. Positioned between each pair of laterally extending rows 43, 43' are peaks 46 which have a smaller base than peaks 42 and which are arranged in laterally extending rows. In a preferred embodiment, the peaks 46 are arranged in serial fashion across the width of mattress cushion 20 and have essentially twice as many peaks as the adjacent lateral row of peaks 42 such that the sum total of peaks within each group of lateral rows 43 and 43' is essentially equal to the total number of peaks 46 within a single lateral row. As will be explained in greater detail below, peaks 46 are of a lesser height than peaks 42 although each originate from a common plane representing the upper surface of the underlying base for mattress cushion 20.

FIG. 2 also illustrates third zone section 50 having a plurality of continuous, zig zag shaped ridges 52 separated by grooves 54. In a preferred embodiment, ridges 52 are spaced along the width W of mattress cushion 20 in 2 inch intervals.

Figure 3:
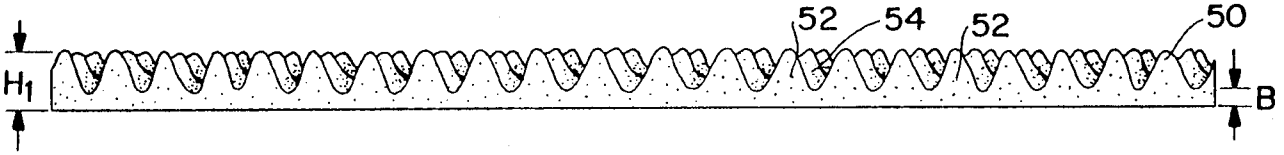
FIG. 3 is an elevational end view of the feet supporting zone of the mattress cushion shown in FIG. 1.
Figure 4:
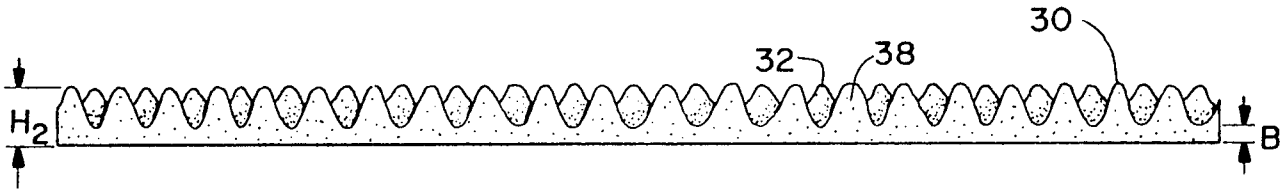
FIG. 4 is an elevational end view of the first zone section which supports the head and shoulders.
Figure 5:
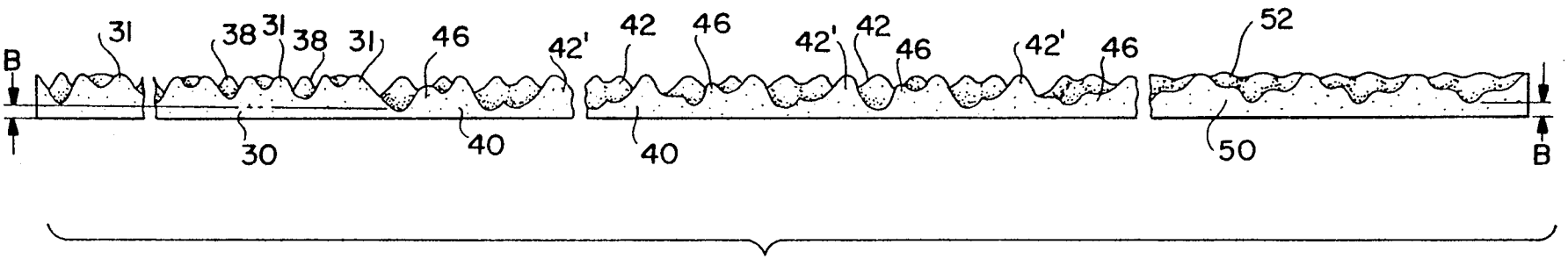
FIG. 5 is an elevational side view of the mattress cushion shown in FIG. 1 partially broken away.

FIG. 3 illustrates an elevational end view of third zone section 50 with zig zag shaped, continuous ridges 52 separated by grooves 54. Continuous ridges 52 are preferably formed of a plurality of protrusions which are integrally formed along adjacent sides so as to form the continuous ridge 52. FIG. 3 also illustrates base height B which is the same for the entire mattress pad as depicted in FIGS. 4 and 5. In a preferred embodiment, base height B is one half of an inch. FIG. 3 also illustrates peak height H1 for zig zag ridges 52 which in a preferred embodiment is about 1.75 inches resulting in a peak to base ratio of 1.75/.5 or 3.50/1.

As noted above, mattress cushion 20 is formed of a single material which in a preferred embodiment has a density value of between 1.2 to 1.6 lb/ft$^3$. In the most preferred embodiment, mattress cushion 20 is formed of a polyurethane foam material either in the form of polyurethane foam sold by E. R. Carpenter, Inc. under the trademark RICHFOAM having code number R45XR or, alternatively, the polyurethane foam sold by E. R. Carpenter, Inc. under the trademark RICHFOAM having code number L32XD.

Preferably, the 25% ILD value for third zone section 50 falls within the range of 4 to 12. The preferred 65% ILD value for the third zone section 50 is about 12 to 30 and the most preferred compression modulus for third zone section 50 is about 2.5 to 2.8 and more preferably about 2.6.

The manner for determining ILD values for the convoluted surfaces of the present invention features the use of a pressure implementing device as described in ASTM D3574-86: standard Methods of Testing Flexible Cellular Materials—Slab, Bonded, and Molded Urethane Foam (Section 16–22) which are incorporated herein by reference. In accordance with the standard method of testing, measurement means are utilized to determine when deflection of the convoluted foam mattress cushion has reached 25% of its total thickness or 65% of its total thickness. Hence, the ILD values for 25% and 65% deflection can be determined by monitoring the force required to achieve either the 25 or 65% deflection.

FIG. 4 shows an elevational end view of first zone section 30 which illustrates individual peaks 38 arranged in laterally extending rows as well as peak 32 which forms a portion of wedge combination 31. In a preferred embodiment, the peaks integrally joined together to form wedge shaped combination 31 are of the same height which is preferably about 1.75 inches. Individual peaks 38 are also preferably about 1.75 inches. The preferred 25% ILD value for the first zone section 30 is between about 5 and 12 with the 25% ILD value for the first zone section being preferably at least 0.5 ILD values greater than that of the third zone section 50. The 65% ILD value for first zone section 30 is preferably between 15 and 35 and the preferred compression modulus for the first zone section is preferably between 2.8 and 3.1 with the compression modulus value for the first zone section being higher then that for the third zone section 50.

Figure 9:
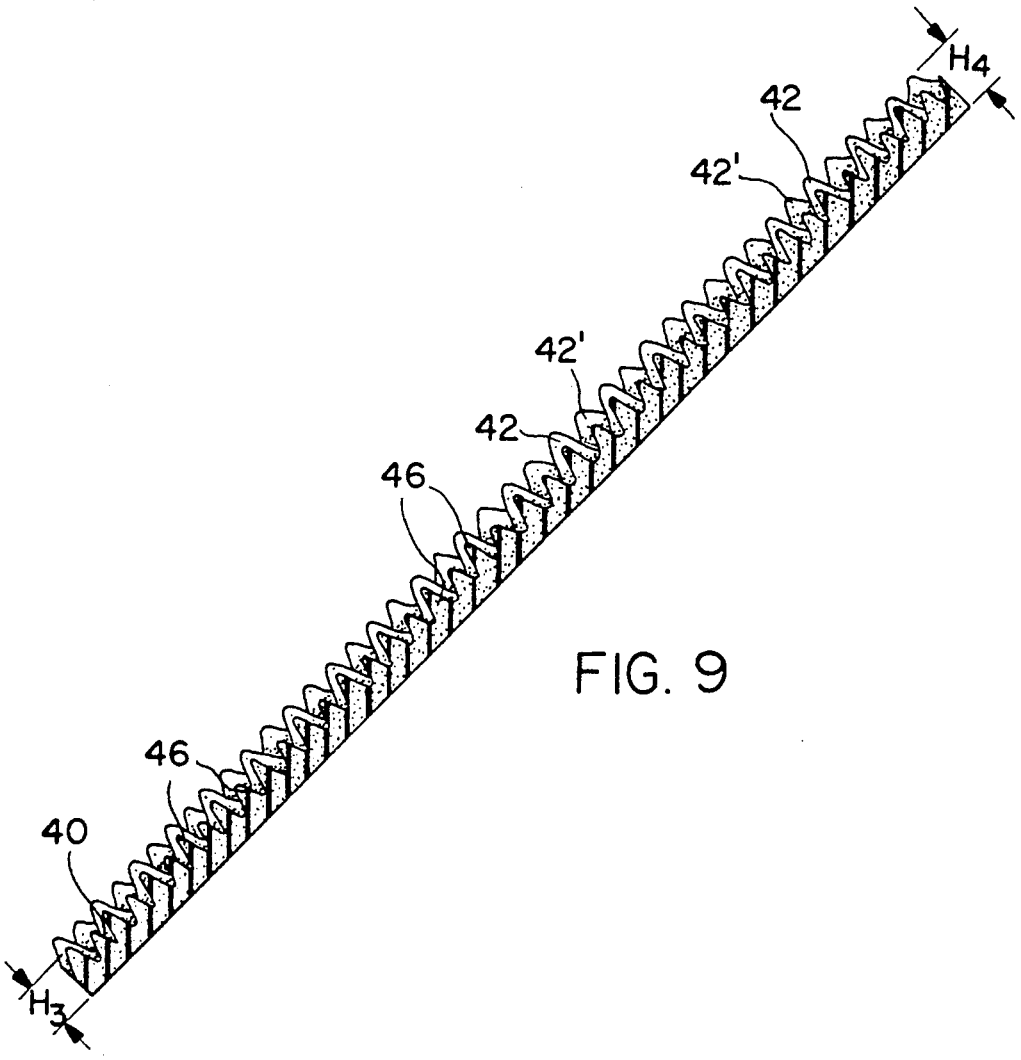
FIG. 9 represents a cross-sectional view taken along cross-section line IX—IX in FIG. 2.

Referring now to FIG. 9 which represents a cross-sectional view taken along cross-section line IX—IX of FIG. 2, there is illustrated lateral rows of individual peaks 46 which are shorter in height than the adjacent peaks 42' and 42 which have been designated H3. Peaks 42 and 42' are preferably of the same height which in a preferred embodiment is 2.0 inches. FIG. 9 illustrates peaks 46 having a cross-section which varies somewhat over the width of second zone section 40. This illustration of a variance in height in FIG. 9 is due to individual peaks 46 being slightly staggered while extending across the width of second zone section 40. Thus, despite the appearance in FIG. 9, peaks 46 are of the same height which, in a preferred embodiment, is 1.75 inches giving a peak to base ratio of 3.5. The height H3 for peaks 42 and 42' of about 2 inches results in a peak to base ratio of about 4. The ratio of H4 over the H3 is preferably between about 1.11:1 to 1.18:1.

The 25% ILD value for the second zone section preferably ranges from about 5 to 10 with the 65% ILD value preferably ranging from 18 to 31. The compression modulus for second zone section 40 preferably falls between 3.1 and 3.5 with the value being higher then that of first zone section 30. Table I is provided below to illustrate the preferred values of peak height, peak to base ratio, density, 25% and 65% ILD values, and the resultant compression modulus. In addition, Table I includes, for comparison purposes, the 25% and 65% ILD values for a solid block of the same material being utilized to form the convoluted mattress cushion as well as the average compression modulus (cm).

TABLE I

| | Description | Height of Peaks (in) | | P/B ratio (Peak to Base) | | Density #/ft$^3$ | Brand Name | ILD Solid Block | | ILD Actual Product |
|---|---|---|---|---|---|---|---|---|---|---|
| ZONE 1 (30) | lateral rows of wedge shaped peak combinations (32,34,36) w/lateral rows of single peaks (38) | 32 | 1.75 | 32 | 3.5 | R = 1.4 plus or 1.4 to 1.6 | Richfoam (R45XR) = R or (L32XD) = L | 25% (R) | 45–51 | 11.2 |
| | | 34 | 1.75 | 34 | 3.5 | | | 25% (L) | 34–40 | 5.9 |
| | | 36 | 1.75 | 36 | 3.5 | | | 65% (R) | 81–92 | 33.3 |
| | | 38 | 1.75 | 38 | | L = 1.25/1.35 | | 65% (L) | 61–72 | 18.3 |
| | | | | | | | | (CM) | 1.8(Avg) 1.8(Avg) | (R) 3.0 (L) 3.1 |
| ZONE | staggered upper | 42 | 2.0 | 42 | 4.0 | R = 1.4 plus | Richfoam | 25% | 45–51 | 9.3 |

TABLE I-continued

| | Description | Height of Peaks (in) | | P/B ratio (Peak to Base) | | Density #/ft$^3$ | Brand Name | ILD Solid Block | | ILD Actual Product |
|---|---|---|---|---|---|---|---|---|---|---|
| 2 | level peaks | 44 | 2.0 | 44 | 4.0 | or | (R45XR) = R | (R) | | |
| (40) | (42,44) | 46 | 1.75 | 46 | 3.5 | 1.4 to 1.6 | or | 25% | 34–40 | 5.9 |
| | alternating w/ | | | | | L = 1.25/1.35 | (L32XD) = L | (L) | | |
| | lower level | | | | | | | 65% | 81–92 | 30.4 |
| | peaks (46) | | | | | | | (R) | | |
| | | | | | | | | 65% | 61–72 | 19.7 |
| | | | | | | | | (L) | | |
| | | | | | | | | (R) (CM) | 1.8 | 3.3 |
| | | | | | | | | (L) (CM) | 1.8 | 3.3 |
| ZONE | zig-zag shaped | 52 | 1.75 | 52 | 3.5 | R = 1.4 plus | Richfoam | 25% | 45–51 | 10.3 |
| 3 | continuous | | | | | or | (R45XR) = R | (R) | | |
| (50) | ridges 52 and | | | | | 1.4 to 1.6 | or | 25% | 34–40 | 5.4 |
| | complimentary | | | | | L = 1.25/1.35 | (L32XD) = L | (L) | | |
| | grooves | | | | | | | 65% | 81–92 | 27.2 |
| | | | | | | | | (R) | | |
| | | | | | | | | 65% | 61–72 | 14.1 |
| | | | | | | | | (L) | | |
| | | | | | | | | (R) (CM) | 1.8 | 2.6 |
| | | | | | | | | (L) (CM) | 1.8 | 2.6 |

FIG. 5 illustrates a partially cut away view of either side of mattress cushion 20 as both would preferably be about the same. The appropriate reference numbers have been assigned to the various peaks and ridges appearing in each of zone sections 30, 40 and 50.

Figure 6:
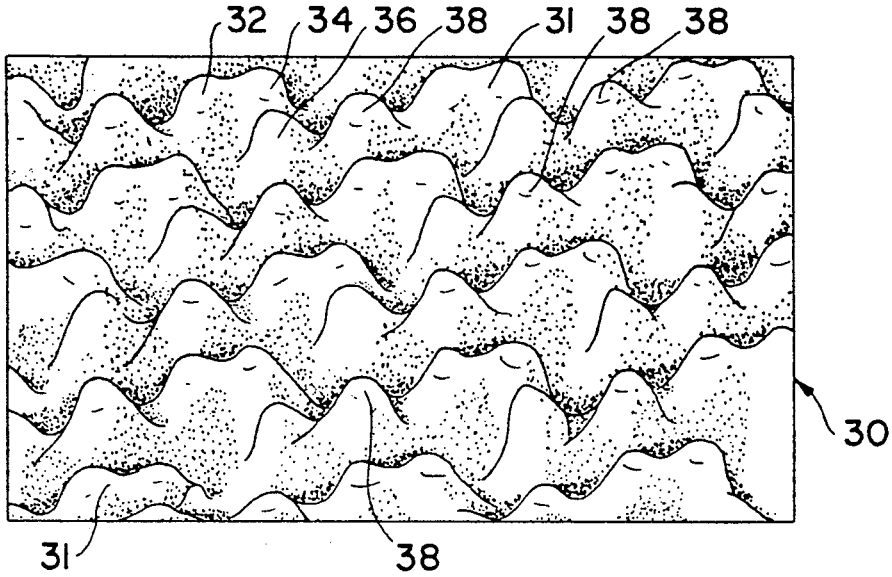
FIG. 6 shows in greater detail a segment of the convoluted upper surface of the first zone section.

FIG. 6 illustrates a close up view of the convoluted surface for first zone section 30. As can be seen from FIG. 6, wedge combinations 31 are formed of essentially three integrally formed peaks denoted 32, 34 and 36. Individual peaks 38, which are arranged in a laterally extending row, are positioned adjacent rows of wedge shaped peak combinations 31.

Figure 7:
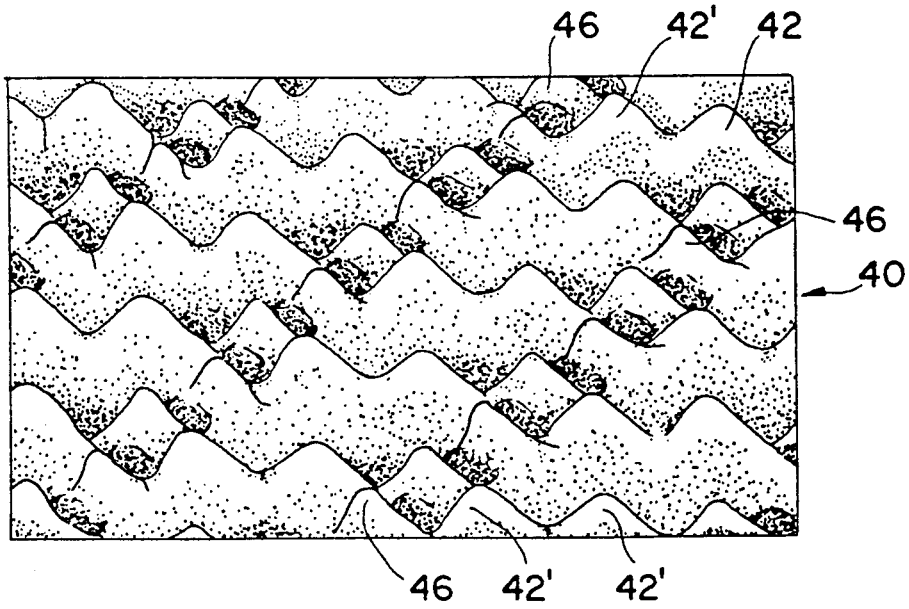
FIG. 7 shows a closeup view of the contoured surface of the second zone section.

FIG. 7 shows a close up view of the contoured surface of second zone section 40 which features rows of individual peaks 46 arranged adjacent rows 43, 43' of higher peaks 42 and 42'.

Figure 8:
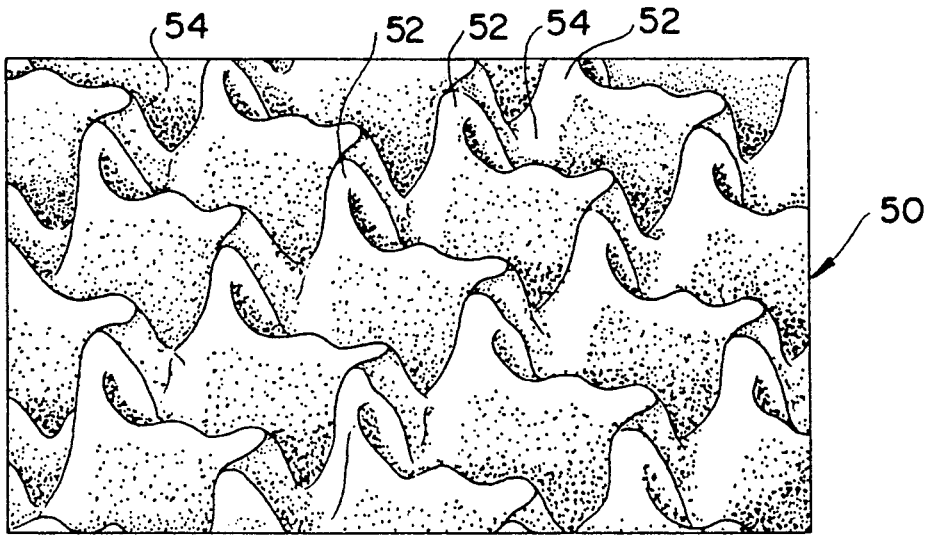
FIG. 8 shows a close up view of the convoluted surface of the third zone section.

FIG. 8 illustrates a close up view of the contoured surface of third zone section 50 which includes a plurality of continuous, zig zag shaped ridges 52 arranged between grooves 54.

In a preferred embodiment, the first set of peaks in the second zone sections constitute about 29% of the entire surface area of the second zone section while the second set constitute about 21%. In the first zone section the wedge shaped peak combinations constitute about 34% while the individual peaks constitute about 16% of the first zone section. The continuous zig zag ridges constitute about 50% of the surface in the third zone section.

The contoured upper surface for mattress cushion 20 can be formed either in a molding process or more preferably by a pair of intermeshing rollers with the foam being fed in between a pair of such rollers having a plurality of outwardly extending teeth. For achieving the two different levels of foam peaks in second zone section 40, a combination of two different sized convoluted rings can be relied upon. One of the convoluted rings features a two inch center foot $\frac{5}{8}$ inch by $\frac{5}{8}$ inch while the other ring features a one inch center foot $\frac{5}{8}$ inch by $\frac{1}{2}$ inch. The foot represents the protrusion arranged circumferentially about the roller base. The two inch center rings have a $1\frac{3}{8}$ inch gap between the feet while the one inch center rings have $\frac{1}{2}$ inch gap between the feet. The wider the gap, the easier it is for foam to be forced into the gap before it is cut. A smaller gap allows in less of the foam which explains how two peak heights can be formed with the upper level, larger base size peaks being formed of the greater proportion of foam forced into the wider gaps.

Tables II and III below illustrate the results of a body contact pressure point test conducted by Twin City Testing Corporation of St. Paul, Minn.

The testing was conducted on a pair of mattress cushions each having the three distinct convoluted zones previously described. The first of the pair of mattress cushions was formed of the previously described L32XD material and is designated by the trademark COMFORT ZONE® of E.R. Carpenter Company, Inc. The second of the pair of tested mattress cushions was formed of the previously described R45XR polyurethane foam and is designated by the trademark PRO-TECH® also of E.R. Carpenter Company, Inc.

The physical properties of the two mattress cushions or overlays were as follows:

(1) COMFORT ZONE mattress cushion (L32XD)—74"×34"×2": weight=2.25 lbs.

(2) PRO-TECH mattress cushion (R45XR)—74"×36"×2": weight=2.25 lbs.

The mattress cushions were tested in conjunction with a standard twin-size innerspring mattress for control purposes.

The test procedure involved the use of a Talley Oxford Pressure Monitor—Model MKII. The innerspring mattress and foundation were placed directly on a concrete floor and the overlays placed over the top. A twin-size fitted sheet was placed over the overlay and mattress to form a smooth surface.

Three subjects were used for the analysis and were selected according to specific weight and height ranges. The subjects were dressed in the same cotton sweat suit with no shoes to ensure proper placement of the 4"×5"—12 sensor pad. Positioning of the sensor pad was accomplished by both the subject and experimenter. Repositioning between the three replications conducted on each subject was also a part of the test procedure.

The subjects weight and height are listed below:

(A) 185 lb—5'10"

(B) 110 lb—5'2"

(C) 150 lb—5'8".

As indicated below four body areas (i.e., shoulder blade, hip, tail bone and heel) were measured with three replications obtained and the results averaged and set forth below in Tables II and III.

With reference to the summary Tables IV and V below, the R45X4 and L32XD illustrate a marked improvement over the control innerspring mattress, especially with respect to the hip area which represents a difficult area to control for decubitus ulcer formation. The values 33 and 36 mm/Hg. approach very closely the value 32 mm/Hg. which is believed by some to represent the pressure which if applied to a bony prominence results in capillary shut down and, ultimately, tissue death. In addition to achieving low pressure results for the hip area, the remaining three problem areas (heel, tailbone and shoulder blade) are shown to be well below the 32 mm/Hg. threshold. Moreover, the values for each of the four problematic areas suggest an equitable distribution of support which is achieved while retaining a relatively low 25% ILD value and a relatively high compression modulus of between about 2.5 to 3.5. Accordingly, the test results indicate that not only are the two mattress pads able to provide low pressure contact points which avoid ulcer formation, but the mattress cushions are also capable of achieving this advantage at a comfortable cushioning level.

TABLE II

| | AVERAGE PRESSURE LEVELS (mm/Hg) | | | |
|---|---|---|---|---|
| | Subject 1 | Subject 2 | Subject 3 | Overall |
| | Comfort Zone (L32XD) | | | |
| Scapula (shoulder blade) | 26 | 22 | 19 | 23 |
| Trochanter (hip) | 38 | 22 | 38 | 33 |
| Sacral Prominence (tailbone) | 25 | 25 | 22 | 24 |
| Heel | 27 | 20 | 18 | 22 |
| | Pro-Tech (R45XR) | | | |
| Scapula (shoulder blade) | 31 | 20 | 21 | 24 |
| Trochanter (hip) | 39 | 22 | 47 | 36 |
| Sacral Prominence (tailbone) | 24 | 24 | 23 | 24 |
| Heel | 32 | 16 | 19 | 23 |
| | No Overlay | | | |
| Scapula (shoulder blade) | 21 | 21 | 28 | 23 |
| Trochanter (hip) | 58 | 33 | 44 | 45 |
| Sacral Prominence (tailbone) | 32 | 25 | 25 | 27 |
| Heel | 27 | 25 | 19 | 24 |

TABLE III

TEST RESULTS SUMMARY

| | AVERAGE PRESSURE VALUES (mm/Hg) | | |
|---|---|---|---|
| | Comfort Zone | Pro-Tech | Innerspring Mattress |
| Scapula (shoulder blade) | 23 | 24 | 23 |
| Trochanter (hip) | 33 | 36 | 45 |
| Sacral Prominence (tailbone) | 24 | 24 | 27 |
| Heel | 22 | 23 | 24 |

Although the present invention has been described with reference to the preferred embodiments, the invention is not limited to the details thereof. Various substitutions and modifications will occur to those of ordinary skill in the art, and all such substitutions and modifications are intended to fall within the spirit and scope of the invention as defined in the appended claims.

What is claimed is:

1. A mattress overlay cushion for use over an underlying mattress, comprising:

a single layer of polyurethane foam material with an elongated longitudinal length and a shorter transverse width, said layer having a first zone section, a second zone section and a third zone section, with each of said zone sections having an upper surface and a lower surface, and each of said zone sections extending for a portion of said elongated longitudinal length, and said first, second and third zone sections, in combination, representing essentially the total of the elongated longitudinal length, and said second zone section extending for a greater percentage than said first zone section and for a greater percentage than said third zone section, and each of said zone sections extending transversely for the entire transverse width of said single layer of polyurethane foam;

said first, second and third zone sections each having a convoluted surface with protuberances arranged in a configuration which is different than that of an adjacent one of said zone sections;

said protuberances in said first and second zone sections including rounded peak members, a plurality of said rounded peaks in said first zone section being arranged in a plurality of transversely extending rows of individual peak members (38) separated by valleys with the rounded peaks in each transversely extending row being offset transversely with respect to a longitudinally adjacent row, and a plurality of said peak members (42, 42') in said second zone section being arranged in sets that are separated by valleys transversely spaced between said sets and each of said peak members within said sets being joined at a base portion in a region above a maximum depth of said valleys such that adjoined peak members extend diagonally with some of said valleys transversely positioned between adjacent sets of diagonally extending adjoined peak members;

said protuberances of said third zone section featuring a plurality of essentially continuous ridge-like members separated by grooves with said grooves extending essentially uninterrupted between adjacent ridge-like members; and said first, second and third zone sections being dimensioned and arranged such that a plane lying flush on the upper surface of each zone section is parallel with a plane lying flush on a respective bottom surface of said mattress overlay, and said first, second and third zone sections being dimensioned and arranged such that said second zone section provides maximum pressure relief, and said first, second and third zone each provide a different amount of pressure relief and wherein differences between the pressure relief capabilities of each zone section provide an equitable distribution of support over the longitudinal length of a person supported on said mattress cushion.

2. A mattress overlay cushion as recited in claim 1 wherein at least one of said zone sections includes protuberances which extend essentially longitudinally in zig-zag fashion.

3. A mattress overlay cushion as recited in claim 1 wherein said first zone section provides a greater amount of pressure relief than said third zone section.

4. A mattress overlay cushion as recited in claim 1 wherein said first zone section is dimensioned and arranged for supporting a head and shoulder of the person supported on the mattress overlay, said second zone section is dimensioned and arranged for supporting a torso section of the person, and said third zone section is dimensioned and arranged for supporting a leg and feet portion of the person.

5. A mattress overlay cushion as recited in claim 1 wherein said second zone section has a higher 25% ILD value than that of said third zone section.

6. A mattress overlay cushion as recited in claim 5 wherein said first zone section has a higher compression modulus value than said third zone section.

7. A mattress overlay cushion as recited in claim 6 wherein said first zone section has a 65% ILD value which is higher than that of said second and third zone sections.

8. A mattress overlay cushion as recited in claim 6 wherein said second zone section has a higher 65% ILD value than said third zone section.

9. A mattress overlay cushion as recited in claim 1 wherein said first zone section has a higher compression modulus value than said third zone section.

10. A mattress overlay cushion as recited in claim 1 wherein said first zone section has a 65% ILD value which is higher than that of said second and third zone sections.

11. A mattress overlay cushion as recited in claim 1 wherein said second zone section has a higher 65% ILD value than said third zone section.

12. A mattress overlay cushion as recited in claim 1 wherein said single layer of foam material is formed of a single type of material.

13. A mattress overlay cushion as recited in claim 1 wherein said single layer of foam has a density of between 1.25 and 1.6 lbs/ft$^3$.

14. A mattress overlay cushion as recited in claim 1 wherein said second zone section is dimensioned and arranged to achieve a pressure reduction which results in a pressure value of 33 mm/$H_S$ for a hip region of a person supported on said mattress cushion overlay.

15. A mattress overlay cushion as recited in claim 1 wherein each of said zone sections has a different compression modulus value.

* * * * *